United States Patent [19]

Jensen

[11] 4,305,564

[45] Dec. 15, 1981

[54] CASTING MOULD FOR THE PRODUCTION OF CONCRETE OR SIMILAR PIPES IN AN UPRIGHT POSITION

[75] Inventor: Johannes Jensen, Brønderslev, Denmark

[73] Assignee: Pedershaab Maskinfabrik A/S, Bronderslev, Denmark

[21] Appl. No.: 203,338

[22] Filed: Nov. 3, 1980

[30] Foreign Application Priority Data

Nov. 5, 1979 [DK] Denmark ..... 4675/79

[51] Int. Cl.[3] ..... B28B 7/06

[52] U.S. Cl. ..... 249/100; 425/DIG. 218

[58] Field of Search ..... 249/100; 425/DIG. 218

[56] References Cited

U.S. PATENT DOCUMENTS

| | | | |
|---|---|---|---|
| 1,941,812 | 1/1934 | Muntz | 249/100 X |
| 2,863,205 | 12/1958 | Seaman et al. | 425/DIG. 218 |
| 3,276,091 | 10/1966 | Pausch | 249/100 X |
| 3,530,553 | 9/1970 | Engle et al. | 425/DIG. 218 |
| 4,134,568 | 1/1979 | Christian | 249/100 X |

FOREIGN PATENT DOCUMENTS

| | | | |
|---|---|---|---|
| 1226474 | 10/1966 | Fed. Rep. of Germany | 249/100 |

*Primary Examiner*—J. Howard Flint, Jr.

*Attorney, Agent, or Firm*—Owen, Wickersham & Erickson

[57] ABSTRACT

The invention relates to the technical problem of providing a simple, efficient and easily operable locking mechanism to releasably clamp the bottom ring to the lower edge of the outer mould in a casting mould for the production of concrete or similar pipes in an upright position. With this in view the locking mechanism comprises a radially slotted, resilient locking ring which by means of an opening and closing mechanism is movable between a locking position in which it engages beneath the outer edge portion of the bottom ring and seals said portion tightly against the lower edge of the outer mould, and a free position in which the inner diameter of the locking ring is larger than the outer diameter of the bottom ring so as to enable said locking ring to pass free of the bottom ring when the recently cast pipe is separated from the mould.

4 Claims, 4 Drawing Figures

CASTING MOULD FOR THE PRODUCTION OF CONCRETE OR SIMILAR PIPES IN AN UPRIGHT POSITION

BACKGROUND OF THE INVENTION

Conventional casting moulds for the production of concrete or similar pipes in an upright position comprise outer and inner mould parts as well as a lower part or a so-called bottom ring and a locking mechanism to releasably clamp said bottom ring to the outer mould.

Vibratory movements are generally applied when using such a casting mould, and the casting mass may further during at least part of the moulding process be charged with a stationary, vertical pressure exerted through an upper mould part consisting of a profiled ring that closes the uppermost end of the annular casting cavity between the outer mould and the inner mould or core and serves to the shaping of the upwards directed end of the pipe. Especially owing to the vibratory movements the casting mass has a marked tendency to penetrate through the joint between the outer mould and the bottom ring, and the said locking mechanism serves to counteract this tendency by clamping the outer edge portion of the bottom ring firmly onto the lowermost edge of the outer mould. In a known embodiment the locking mechanism is constituted by a number of separate toggle lock devices mounted on the exterior of the outer mould part, or the outer mould, and which in their locking position engage under the outer edge portion of the bottom ring and tighten it firmly against the lower edge of the outer mould.

After the casting mass has been sufficiently vibrated the casting is removed from the mould in the way that the profiled ring, if any, is raised and then swung aside, the outer mould and the bottom ring with the newly cast tube being subsequently raised from the interior mould part or core by an upward displacement and then brought to a hardening station. At this station the toggle lock devices are released, following which the outer mould is removed from the pipe by an upward displacement and is then ready for renewed use while the newly cast pipe remains standing on the bottom ring till it has become sufficiently stable.

The known toggle lock devices are comparatively expensive as regards both manufacture and operation. Thus, they are composed of a large number of separate elements that are exposed to considerable wear, particularly by the influence of vibrations which might imply that the bottom ring shows a tendency to rotate slowly relative to the outer mould part, thereby causing a disadvantageous lateral loading on the toggle lock devices. Moreover, the locking and releasing operations of said toggle devices require considerably manual work inasmuch as large pipe diameters might necessitate the use of twelve to fourteen individual locks to obtain the necessary tightness between the bottom ring and the outer mold part. Particularly the release operation causes a further drawback, viz. that a certain clearance is required around the outer mould which prevents a close arrangement of recently cast pipes at the hardening station unless the pipes are displaced subsequent to the removal of the outer mould which, however, is troublesome and involves the risk of damage to the pipes.

SUMMARY OF THE INVENTION

The said drawbacks and deficiencies of the prior art are remedied by the casting mould according to the present invention which is characterised in that the locking mechanism comprises a locking ring attached to the outer mould, said locking ring being radially expansible and being also movable between a locking position in which it engages beneath the outer edge portion of the bottom ring and clamps this portion firmly against the lower end of the outer mould, and a free position in which its inner diameter is larger than the external diameter of the bottom ring.

An essential advantage of this structure is that the bottom is clamped to the lower edge of the outer mould along its entire circumference in lieu of being secured at a number of spaced apart points, and an additional advantage is that the locking ring only requires a single releasing and locking mechanism to change it from the locking position to the release position and vice versa, and the locking ring is, moreover, the only element that is seriously exposed to wear. Still further, this locking mechanism need only entail an almost insignificant increase of the external diameter of the outer mould, thereby permitting an efficient utilization of the hardening station.

In a preferred embodiment of the casting mould according to the invention the locking ring is a radially slotted resilient ring mounted slidably in a guide, attached to the outer mould, and having adjacent the slot an opening and closing mechanism for respectively widening and narrowing the slot, said ring being at least at one point prevented from moving in the circumferential direction in relation to the guide. The latter measure contributes to reduce wear of the locking ring and may further improve its ability to resist the above mentioned tendency of the bottom ring to rotate slowly in relation to the outer mould part.

DETAILED DESCRIPTION OF THE PREFERRED EMBODIMENT

Figure 1:
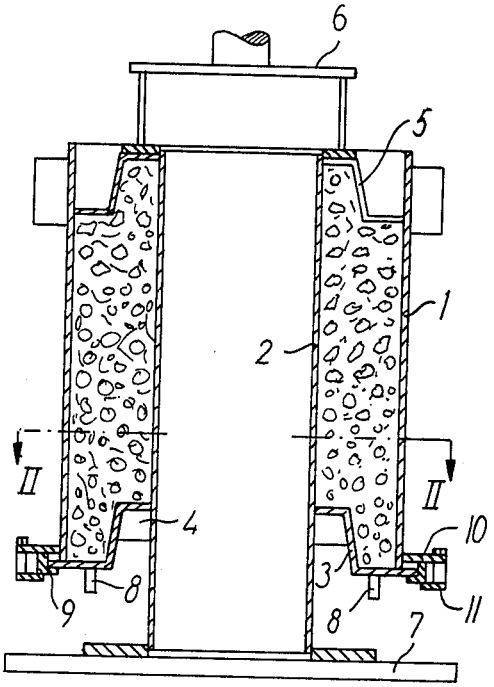
FIG. 1 is a somewhat diagrammatic axial section through a preferred embodiment of a complete casting mould according to the invention with a recently cast concrete pipe therein.

The mould shown in FIG. 1 for the manufacture of concrete pipes comprises an outer mould part or outer mould 1, an inner mould part or core 2, a lower mould part or bottom ring 3 resting loosely on a support ring 4 stationarily mounted on the core 2, and an upper mould part 5, supported by a presser head 6. The core 2 stands on a table 7 that may be resiliently supported, and the casting mould may in a known manner be provided with vibrators, not shown. As will appear from FIG. 1 the bottom ring 3 may have legs 8 so that the bottom ring per se may occupy a raised position above the floor when the bottom ring and the recently cast pipe are set aside to be subjected to the hardening process.

Figure 2:
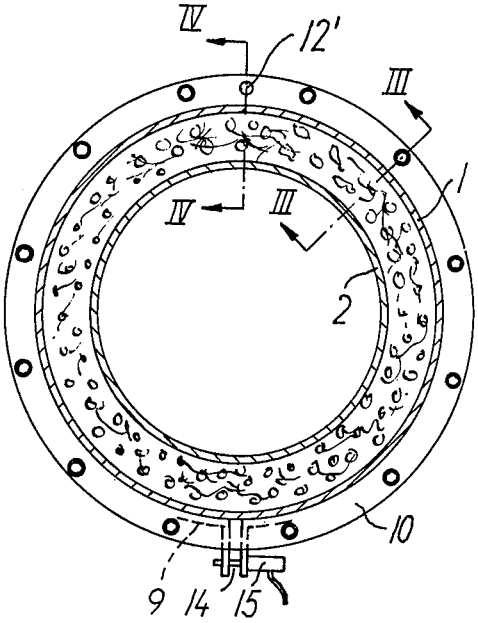
FIG. 2 is a cross-section on a larger scale on line II—II in FIG. 1.

A locking ring 9 serves to clamp the bottom ring 3 against the lower edge of the outer mould 1, said locking ring 9 being a radially slotted, resilient ring with plane and parallel upper and lower surfaces and mounted displaceably in a guide consisting of a reinforcing ring 10 secured to the outer mould 1 and a support ring 11 that is parallel to said reinforcing ring 10 and is firmly connected therewith through a circular series of bolts 12 positioned outside the outer periphery of the locking ring 9 so that said locking ring has sufficient clearance for a restricted movement in the guide. The restriction is provided by means of a stationary pin 12', FIGS. 2 and 4, extending through a radially elongate aperture 13 in the locking ring and thus preventing its movement in the circumferential direction but allowing a certain radial movement. In FIG. 2, the pin 12' is diametrically opposite to the slot 14 of the locking ring. The said slot 14 may be widened and narrowed by means of an opening and closing mechanism which on the drawings is symbolized by a hydraulic or pneumatic cylinder 15 supposed to be secured to the one of a pair of flanges located on either side of the slot 14, the other flange of said pair being secured to the piston rod of said cylinder. This opening and closing mechanism may, however, have numerous other forms and may for instance be mounted on the top of the reinforcing ring 10 which must then have appropriate apertures for the connection between the said mechanism and the ends of the locking ring 9.

Figure 3:
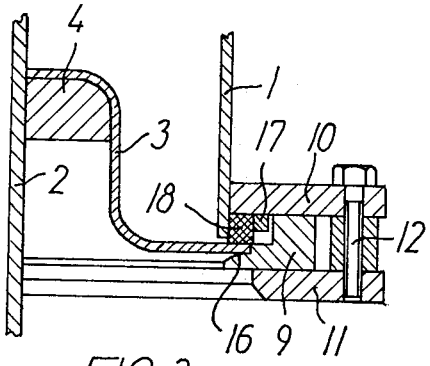
FIG. 3 is a partial section on a still larger scale on line III—III in FIG. 2.
Figure 4:
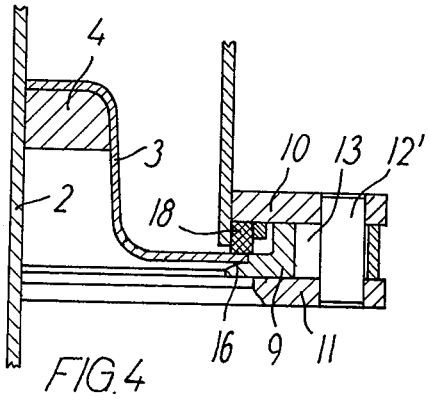
FIG. 4 is a similar partial section on line IV—IV in FIG. 2.

As it will best appear from FIGS. 3 and 4 the locking ring has an angular cross-section in which the horizontal flange that is slidably arranged on the support ring 11 has an internal notch 16 to receive the edge portion of the bottom ring 3 when the locking ring is in its locking position. In this position the circumferential surface of the notch 16 engages firmly about the edge portion of the bottom ring, thus contributing to impede the rotating movement of the bottom ring. In certain circumstances such a movement may, however, be desirable, and if so, the locking ring 9 may instead rest firmly against another element of the structure, for instance against a retaining ring 17 mounted on the reinforcing plate 10 and holding a packing 18 which in the shown embodiment improves the tightness between the outer mould 1 and the bottom ring 3.

What is claimed is:

1. A casting mould for the production of concrete and similar pipes in an upright position, comprising outer and inner mould parts defining an annular casting cavity, a lower mould part forming a bottom ring closing the lower end of said cavity, and a locking mechanism to releasably clamp said bottom ring to said outer mould, said locking mechanism comprising a radially expansible locking ring attached to the outer mould, and being movable between a locking position in which it engages beneath the outer edge portion of the bottom ring and is operative to clamp it firmly against the lower end of the outer mould, and a released position in which its inner diameter is larger than the external diameter of the bottom ring.

2. A casting mould as claimed in claim 1, wherein the locking ring is a radially slotted resilient ring mounted slidably in a guide attached to the outer mould and having means to restrict movement of said ring in the circumferential direction in relation to the guide, an opening and closing mechanism being provided for widening and narrowing the slot of said ring.

3. A casting mould as claimed in claim 2, wherein the guide consists of a reinforcing ring secured to the outer mould and a support ring that is firmly connected with the reinforcing ring through a circular series of bolts positioned outside the outer periphery of the locking ring, the guide comprising a pin in engagement with a radially elongate aperture in the locking ring for preventing its movement in the circumferential direction.

4. A casting mould as claimed in claim 2, wherein the locking ring has an internal notch to receive the edge portion of the bottom ring, the circumferential surface of said notch in the operative locking position clamping firmly around said edge portion.

* * * * *